US006906273B2

(12) United States Patent
Searle et al.

(10) Patent No.: US 6,906,273 B2
(45) Date of Patent: Jun. 14, 2005

(54) SWITCH ASSEMBLY

(75) Inventors: Gary M. Searle, Norfolk, MA (US); Steve Kille, Amesbury, MA (US)

(73) Assignee: Stoneridge Control Devices, Inc., Canton, MA (US)

( * ) Notice: Subject to any disclaimer, the term of this patent is extended or adjusted under 35 U.S.C. 154(b) by 0 days.

(21) Appl. No.: 10/638,946

(22) Filed: Aug. 11, 2003

(65) Prior Publication Data

US 2004/0108194 A1 Jun. 10, 2004

Related U.S. Application Data

(60) Provisional application No. 60/402,504, filed on Aug. 9, 2002.

(51) Int. Cl.[7] ..... H01H 13/70
(52) U.S. Cl. ..... 200/511; 200/5 A; 200/343
(58) Field of Search ..... 200/511, 512, 200/5 A, 513–517; 400/490–495

(56) References Cited

U.S. PATENT DOCUMENTS 4,423,299 A * 12/1983 Gurol et al. ..... 200/512
4,916,275 A * 4/1990 Almond ..... 200/516
5,120,912 A * 6/1992 Sharp ..... 200/512
5,990,435 A * 11/1999 Chao ..... 200/517
6,027,267 A * 2/2000 Yokobori ..... 200/343

* cited by examiner

*Primary Examiner*—Elvin Enad
*Assistant Examiner*—M. Fishman
(74) *Attorney, Agent, or Firm*—Grossman, Tucker, Perreault & Pflager, PLLC

(57) ABSTRACT

A switch assembly movable between a closed position and open position includes a multilayer circuit. The multilayer circuit includes a first layer having a first conductive material disposed thereon, a second layer having a second conductive material disposed thereon, and a third layer disposed between the first the second layer, the third layer having an opening therein to permit contact between said first conductive material and said second conductive material when the switch assembly is in the closed position. An actuator such as a rubber dome enables a customer to provide a force to move the switch assembly between closed and open positions. The actuator also meets tactile feel requirements for customer actuated switch applications.

16 Claims, 1 Drawing Sheet

SWITCH ASSEMBLY

CROSS REFERENCE TO RELATED APPLICATIONS

This application claims the benefit of the filing date of U.S. Provisional Application Ser. No. 60/402,504, filed Aug. 9, 2002, the teachings of which are incorporated herein by reference.

FIELD OF THE INVENTION

The present invention relates generally to electrical switches, and in one embodiment, to electrical switches for automotive use.

BACKGROUND OF THE INVENTION

Common user actuated switches utilize rocker or push button style actuators to close contacts on a printed circuit board (PCB) or contact unit. The two most common methods to make this contact closure are to use microswitches or rubber domes, but rubber domes are susceptible to contamination.

Microswitches used for customer actuated switch (CAS) applications are typically sealed from contamination and rated for automotive use to assume proper function in extreme conditions and high cycle life. Depending on switch design, the microswitch might also have a preload stroke to absorb the manufacturing tolerances of the components and eliminate any buzz, squeak, or rattle conditions. The actuation force of the microswitch from excessive forces that can occur after contact closure is made. Unfortunately, these microswitches are generally cost prohibitive.

One alternative is to use an elastomer pad with integral buttons, also referred to as rubber dome pad or mat. With this design, a carbon or plated (Au or Ag) disk-shaped contact is insert molded inside each contact dome on the mat. The mat is placed over the surface of a PCB and the dome contacts align with the contact closures on the PCB surface. The switch actuator, either rocker or push button, collapses the rubber dome and the contact disk makes a connection across the contact closure on the PCB. Tactile force and stroke can be controlled by the design of the rubber dome. Although this design is less expensive than sealed microswitches, contamination is an inherent problem. The elastomer pad is not sealed to the PCB, and there is a tendency for the contamination to be drawn in the contact area as the dome returns to the open position.

Accordingly, there is a need for a switch assembly that is sealed from contamination, can meet specified tactile requirements for a CAS, i.e. force and tactile feel, and is cost effective and reliable.

BRIEF SUMMARY OF THE INVENTION

A switch assembly movable between a closed and open position consistent with the invention includes a multilayer circuit and an actuator. The multilayer circuit includes a first layer having a first conductive material disposed thereon, a second layer having a second conductive material disposed thereon, and a third layer disposed between the first and second layer, the third layer having an opening therein to permit contact between the first conductive material and the second conductive material when the switch assembly is in the closed position. The actuator is configured to provide force to the first layer to permit the first conductive material and the second conductive material to contact in the closed position and to enable separation of the first conductive material and the second conductive material in the open position.

In another embodiment consistent with the invention, a multilayer circuit switch assembly having an open and closed position is provided. The multilayer circuit includes: a first layer first layer having a first conductive material disposed thereon; a second layer having a second conductive material disposed thereon; and a third layer disposed between the first and second layer, the third layer having an opening therein to permit contact between the first conductive material and the second conductive material when the multiple layer circuit is in a closed position.

In yet another embodiment consistent with the invention, a method of making electrical contact is provided. The method includes: providing a first layer having a first conductive material disposed thereon; providing a second layer having a second conductive material disposed thereon; providing a third layer disposed between the first and second layer, the third layer having an opening therein; positioning the first layer proximate to the second layer; and applying force to the first layer so pass the first conductive material through the opening in the third layer to contact the second conductive material.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION

Figure 1:
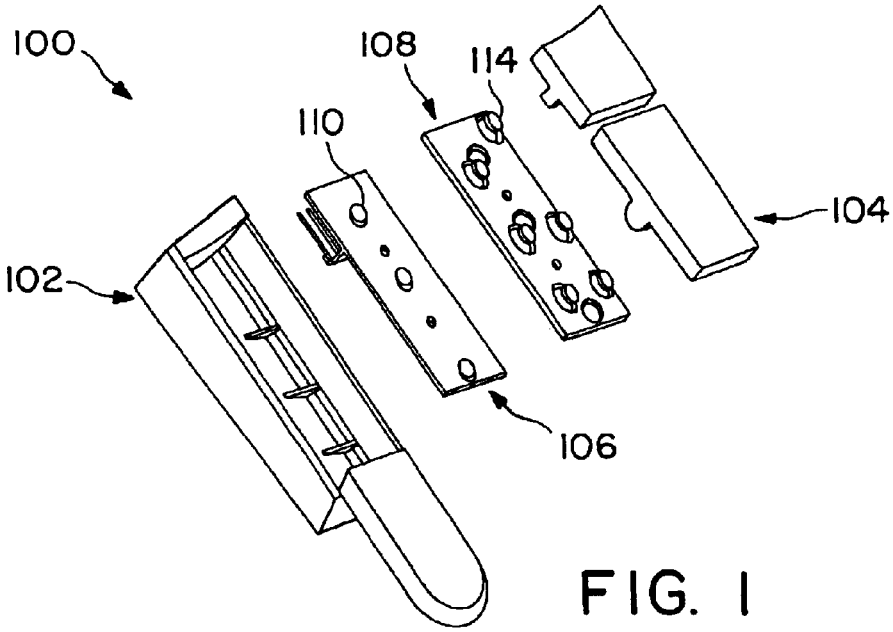
FIG. 1 is an exploded view of an exemplary switch assembly consistent with the invention.

FIG. 1 illustrates a switch assembly 100 consistent with the invention. In general, the switch assembly 100 includes an upper housing 104, lower housing 102, multilayer circuit 106, and actuator portion 108. An exemplary switch assembly consistent with the invention may be constructed from polymer thick film (PTF) techniques. PTF technology employs screen printing to deposit or coat insulators, conductive tracks, and resistors onto a thermoplastic film substrate. The PTF inks that are screen printed are basically pastes that contain a functional phase dispersed in an organic solvent that, when cured, provides the desired cohesion for the printed ink and adhesion to the polymer substrate.

Figure 2A:
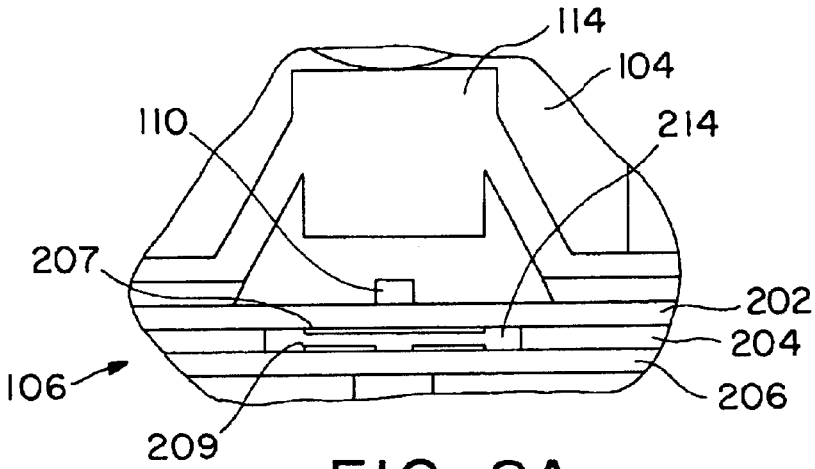
FIG. 2A is a sectional view of an exemplary switch assembly consistent with the invention showing the switch in an open position.
Figure 2B:
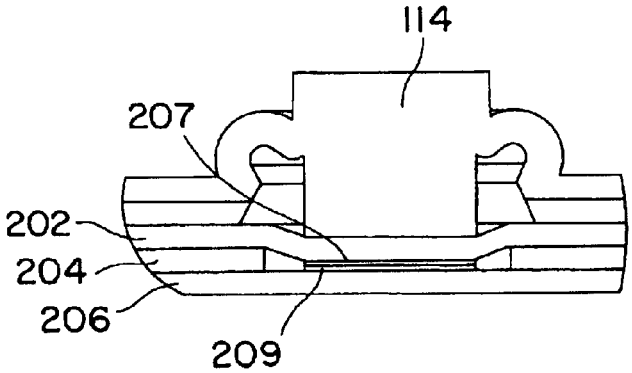
FIG. 2B is a sectional view of and exemplary switch assembly consistent with the invention showing the switch in a closed position.

Turning to FIG. 2A a cross sectional view of a switch assembly consistent with FIG. 1 is illustrate revealing more details of the switch assembly and, in particular the multilayer circuit 106. The cross sectional view of FIG. 2A illustrates the switch assembly in an open position while the cross sectional view of FIG. 2B illustrates the switch assembly in a closed position.

The multilayer circuit 106 may include a top layer 202 having a conductive material 207 disposed thereon and a bottom layer 206 also having a conductive material 209 disposed thereon in a position relative to the first conductive material. In between the top layer 202 and bottom layer 204 may be an insulation layer 204 including an opening 214. The opening 214 may be any variety of sizes large enough to permit the passage there through of the first conductive material 207 so that the first conductive material 207 may contact the second conductive material 209 when the switch assembly is in a closed position as illustrated in FIG. 2B. The conductive materials 207, 209 electrically connect in this closed position of FIG. 2A.

The top 202 and bottom 206 layers may be formed using PTF techniques and include the layer being a thermoplastic film substrate. The insulating layer 204 may be an unprinted layer. This multilayer circuit assembly 106 can be hermetically sealed by applying pressure sensitive adhesive around the perimeter between two adjacent layers. This multilayer circuit assembly 106 may withstand 100,000 or more cycles at extreme temperatures.

To meet tactile feel requirements, an exemplary switch consistent with present invention combines the multilayer circuit 106 with an actuator 114. The actuator 114 is provided to meet the tactile requirements, so it does not require conductive disks. The actuator may be a rubber dome mat in one embodiment. When the rubber dome mat is combined with a multilayer circuit 106 consistent with the invention, it is less expensive than the rubber dome/PCB technology, and is not subject to contamination. Other means of meeting the tactile feel criteria, such as molded-in-spring features, compression springs, eyelet assemblies, plunger bumpers, etc., may be used.

In operation, a user of the customer activated switch assembly 100 would engage the actuator 114 with a force. In turn, the actuator 114 would provide a force to the top layer 202 of the multilayer circuit 106. The top layer 202 may also have a protrusion 110 or similar mechanical feature to permit enhanced mechanical coupling between the actuator 114 and the top layer 202. The top layer 202 including the conductive material 207 disposed thereon is forced towards the conductive material 209 on the bottom layer 206. Advantageously, the insulating layer 204 has an opening 214 large enough to permit the passage of the conductive material 207 through the opening 214. When proper electrical contact is made between the conductive material 207 of the top layer 202 and the conductive material 209 of the bottom layer 206, the switch is in the closed position of FIG. 2B.

When the operator engages the actuator again to open the switch, the force provided by the actuator against the top layer 202 is removed. The top layer 202 may be made of a resilient material such that when the force applied by the actuator 114 is removed, the top layer 202 returns to its undeformed position of FIG. 2A or the open position. Alternatively, the top layer 202 may return to its position of FIG. 2A by applying a force to the top layer. In the position of FIG. 2A, a sufficient separation distance is maintained between the conductive material 207 and the conductive material 209 such that the there is no electrical coupling between the conductive materials 207 and 209.

It is to be understood that the embodiments that have been described herein are but some of the several which utilize this invention and are set forth here by way of illustration, but not of limitation. It is obvious that many other embodiments, which will be readily apparent to those skilled in the art may be made without departing materially from the spirit and scope of the invention.

What is claimed is:

1. A switch assembly movable between a closed and open position, said switch assembly comprising:

a multilayer circuit comprising a first layer comprising opposed first and second surfaces, said first layer having a first conductive material disposed on said first surface thereof and a protrusion extending from said second surface thereof, a second layer having a second conductive material disposed thereon, and a third layer disposed between said first and second layer, said third layer having an opening therein to permit contact between said first conductive material and said second conductive material when said switch assembly is in said closed position; and an actuator configured engage said protrusion to provide force to said first layer to permit said first conductive material and said second conductive material to contact in said closed position and to enable separation of said first conductive material and said second conductive material in said open position.

2. The switch assembly of claim 1, wherein said first conductive material is coupled to said first layer by using a polymer thick film (PTF) technique and said first layer comprises a thermoplastic film substrate.

3. The switch assembly of claim 1, wherein said second conductive material is coupled to said second layer by using a polymer thick film (PTF) technique and said second layer comprises a thermoplastic film substrate.

4. The switch assembly of claim 1, wherein said actuator comprises a rubber dome mat.

5. The switch assembly of claim 1, wherein said actuator is selected from the group consisting of a plunger bumper, a rubber dome mat, and an eyelet assembly.

6. The switch assembly of claim 1, wherein said first layer has a first position and a second position, said first conductive material contacting said second conductive material when said first layer is in said first position and said first conductive material separate from said second conductive material when said first layer is in said second position.

7. The switch assembly of claim 6, wherein a force applied by said actuator forces said first layer into said first position.

8. The switch assembly of claim 7, wherein said first layer returns to said second position when said force is removed.

9. The switch assembly of claim 1, wherein said multilayer circuit is hermitically sealed.

10. A multilayer circuit switch assembly having an open and closed position, said multilayer circuit comprising:

a first layer comprising opposed first and second surfaces, said first layer having a first conductive material disposed on said first surface thereof and a protrusion extending from said second surface thereof for engaging an actuator;

a second layer having a second conductive material disposed thereon; and a third layer disposed between said first and second layer, said third layer having an opening therein to permit contact between said first conductive material and said second conductive material when said multiple layer circuit is in a closed position.

11. The multilayer circuit switch assembly of claim 10, wherein said first conductive material is coupled to said first layer by using a polymer thick film (PTF) technique and said first layer comprises a thermoplastic film substrate.

12. The multilayer circuit switch assembly of claim 10, wherein said second conductive material is coupled to said second layer by using a polymer thick film (PTF) technique and said second layer comprises a thermoplastic film substrate.

13. The multilayer circuit switch assembly of claim 10, wherein said first layer has a first position and a second position, said first conductive material contacting said second conductive material when said first layer is in said first position and said first conductive material separate from said second conductive material when said first layer is in said second position.

14. The multilayer circuit switch assembly of claim 13, wherein a force moves said first layer from said second position to said first position.

15. The multilayer circuit switch assembly of claim 14, wherein said first layer returns to said second position when said farce is removed.

16. A method of making electrical contact, said method comprising:

providing a first layer comprising opposed first and second surfaces, said first layer having a first conductive material disposed on said first surface thereof and a protrusion extending from said second surface thereof;

providing a second layer having a second conductive material disposed thereon;

providing a third layer disposed between said first and second layer, said third layer having an opening therein;

positioning said first layer proximate to said second layer, and applying force to said protrusion to force said first conductive material through said opening in said third layer to contact said second conductive material.

* * * * *